US006880313B1

(12) United States Patent
Gessford et al.

(10) Patent No.: US 6,880,313 B1
(45) Date of Patent: Apr. 19, 2005

(54) METHOD FOR BUNDLING MULTIPLE ARTICLES TOGETHER WHILE OBSCURING INDIVIDUAL IDENTIFICATION CODES AND RELATED ASSEMBLY

(75) Inventors: Douglas Kerr Gessford, Mount Sterling, KY (US); James Daryl Eason, Lexington, KY (US)

(73) Assignee: Gateway Manufacturing, Inc., Mt. Sterling, KY (US)

( * ) Notice: Subject to any disclaimer, the term of this patent is extended or adjusted under 35 U.S.C. 154(b) by 22 days.

(21) Appl. No.: 10/035,622

(22) Filed: Dec. 28, 2001

(51) Int. Cl.[7] ..... B65B 53/02
(52) U.S. Cl. ..... 53/442; 53/415
(58) Field of Search ..... 53/442, 415, 411, 53/461, 509; 206/459.5; 340/572.1

(56) References Cited

U.S. PATENT DOCUMENTS 3,222,800 A 12/1965 Siegel et al.
3,295,290 A * 1/1967 Billinsley et al. ..... 53/442
3,309,835 A 3/1967 Peppler
3,331,503 A 7/1967 Brown
3,338,404 A 8/1967 Becker et al.
3,353,326 A 11/1967 Becker
3,362,128 A 1/1968 James
3,388,788 A 6/1968 Hellem
3,493,106 A 2/1970 Galli
3,610,412 A 10/1971 Morse et al.
3,756,395 A 9/1973 Ganz
3,756,397 A 9/1973 Ganz
3,788,463 A 1/1974 Ruff
3,878,943 A 4/1975 Ryan et al.
4,207,221 A 6/1980 Tobias et al.
4,263,725 A 4/1981 Ganz
4,289,236 A * 9/1981 Ganz et al. ..... 206/459.5
4,475,653 A 10/1984 Ullman
4,669,611 A 6/1987 Flaherty
4,827,114 A 5/1989 Blachon
4,850,488 A 7/1989 Humbert
4,941,573 A 7/1990 Fuerstman
5,177,368 A 1/1993 Kay
5,492,222 A 2/1996 Weaver
5,544,749 A 8/1996 Watts
5,558,213 A 9/1996 Sutherland
5,570,787 A * 11/1996 Danovaro et al. ..... 206/428
5,657,870 A * 8/1997 Schottle et al. ..... 206/459.5
5,667,071 A 9/1997 Nakagoshi et al.
5,736,929 A * 4/1998 Schrott et al. ..... 340/572.1

(Continued)

*Primary Examiner*—Louis Huynh
(74) *Attorney, Agent, or Firm*—Stites & Harbison, PLLC; David W. Nagle, Jr.; Mandy V. Wilson

(57) ABSTRACT

Methods for bundling together groups of two or more articles for selectively obscuring individual identification codes on the articles and related assemblies are disclosed. In one embodiment, the method includes forming a composite film sleeve partially of a clear or transparent film and partially of a colored, opaque, or patterned film. The composite sleeve is then placed over a group of two or more articles slated for bundling and shrunken, if necessary. As a result, any advertising indicia or product information can be viewed by an observer, but the individual identification codes are obscured. Alternative methods of obscuring individual identification codes on groups of articles in a bundle while allowing for the visualization of the advertising indicia or product information thereon are also disclosed.

11 Claims, 4 Drawing Sheets

U.S. PATENT DOCUMENTS 5,788,076 A 8/1998 Simmons
5,797,493 A * 8/1998 Watson ..... 206/443
5,887,717 A 3/1999 Anderson et al.
5,982,284 A * 11/1999 Baldwin et al. ..... 340/572.1
5,992,630 A 11/1999 Brown et al.
6,050,399 A 4/2000 Pratt
6,098,892 A * 8/2000 Peoples, Jr. ..... 235/494
6,116,421 A 9/2000 Collins
6,213,293 B1 4/2001 Marco
6,222,452 B1 * 4/2001 Ahlstrom et al. ..... 340/572.1

* cited by examiner

METHOD FOR BUNDLING MULTIPLE ARTICLES TOGETHER WHILE OBSCURING INDIVIDUAL IDENTIFICATION CODES AND RELATED ASSEMBLY

TECHNICAL FIELD

The present invention relates generally to forming a single bundle or "multi-pack" from a plurality of products or articles and, more particularly, to a method for packaging or bundling multiple products or articles together so as to easily and reliably obscure the individual identification codes on each of the articles, such as to prevent an automated scanner from reading the codes.

BACKGROUND OF THE INVENTION

In recent years, "super" department stores, such as the ubiquitous Wal-Mart or Meijers, and warehouse stores, such as Costco or Sam's Club, have proliferated. Customers are primarily drawn to these types of establishments because the corresponding retailers maintain a large inventory of products and/or to sell products in "bundles" or in bulk, both of which generally allow for lower retail prices to be maintained.

To attract customers away from the competition, these types of retailers are constantly searching for ways to offer their products at the lowest possible retail price, such as by cutting in-house costs while retaining a reasonable profit margin. One area often targeted for cost savings and price reduction is product distribution. For example, most of the warehouse-type stores or "super" department stores no longer rely on an offsite "warehouse" for storing large amounts of articles for a long period of time, since this increases the overall cost (which in turn drives up the retail price or reduces the profit, even if a competitive retail price is maintained). Rather, the retailer simply has a central or regional distribution center that receives the articles in bulk from the manufacturer or an intermediary, such as a contract packager. The primary function of the distribution center is to sort the articles or products received in bulk for routing directly to the stores in scientifically determined quantities for placement directly on the shelves to meet consumer demand (as measured by recent sales history data gathered by the retail store's computer system each time a cashier scans an identification (bar) code on a product being sold).

To facilitate distribution efficiency, it is known to bundle pre-packaged products or articles in "multi-packs," each comprising a certain predetermined quantity of articles for distribution. For example, in the case of ink-jet cartridges for printers, the manufacturer pre-packages each cartridge individually, but then may further "bundle" a pre-determined number of the individually packaged cartridges together (e.g., a "two" or "four" pack), usually for more efficient distribution. In the exemplary cases of a two or four pack of articles, it should be appreciated that the counting and shipping redundancy is essentially reduced two or four fold, respectively, which results in a more efficient operation and consequently reduces the retailer's costs.

However, in the case of a retailer or manufacturer, a significant problem may arise in checking the multi-pack bundle into the distribution center, which is required to later account for the amount of stock of a particular article on hand and maintain the most efficient distribution operation. Usually, this check-in procedure involves the use of an automated scanner for scanning a machine-readable identification code, such as a universal product code (UPC) or "bar" code, placed on the bundle containing multiple articles. This "bundle" identification code typically includes information on, among other things, the type and number of articles in the bundle, but may even include other important information, such as the presence of anti-theft devices on the articles or in their packaging (usually only in the case where the manufacturer's distribution center is involved). However, a problem arises because the automated scanner cannot differentiate between the individual identification codes on the articles and the bundle identification code. Consequently, if the scanner inadvertently scans the individual identification code (and assuming it recognizes this "universal" code), it may reflect the presence of only a single article in inventory (or none, if the identification code is not recognized by the system), rather than the plurality of articles actually present. As a result, the distribution center may ship substantially more articles than it believes were received, and certainly more than requested. This same product diversity with the aforementioned problems exist in the manufacturer's distribution center and results in the similar requirements for package identification. For example, in the case of a retailer, if checked in as individual articles, ten four packs (forty articles) could be shipped to a particular location, when in fact the retailer's computer system shows a deficit of only ten articles. Hence, the retailer would receive four times as many articles as are needed for placement on the shelves, which is obviously deleterious. Using this same example, if the automated scanner scans, but does not recognize the individual identification codes on the articles in four article multi-packs, but they nevertheless proceed to a temporary on-site storage area, the distribution center may show no articles on hand available for shipping, when in fact it received forty that were not properly accounted for (and are likely now lost in the system). As can easily be appreciated, this problem leads to much confusion, increases short-term costs, and substantially reduces efficiency.

Placing multiple articles in a cardboard "carrier," such as a tray or sleeve, is known. These carriers are normally designed to be used in a fixed orientation, and usually cover only certain sides of the group of articles forming the bundle. Therefore, the carrier may not obscure the individual identification codes on the lateral sides or tops of the articles. Consequently, even when such cardboard carriers are used, manual scanning of the bundle may be required to achieve an accurate count.

Another problem with the carrier is that the manufacturer typically purchases only a single shipping container or carton capable of receiving a certain number of the pre-packaged articles in relatively tight engagement, regardless of whether they are pre-bundled or not. The ability to pack the articles tightly in the shipping carton is of course important in most cases to prevent shifting and concomitant damage during delivery. However, the presence of the cardboard tray or carrier may interfere with the ability of the manufacturer or their contract packager to return all the bundles of articles to the original shipping carton in an easy or efficient manner. Not only can this lead to wasted time, but may also result in cartons being shipped with fewer articles when bundling is undertaken (or may necessitate the use of different sizes of cartons, depending on whether the articles are bundled or not, which significantly complicates the overall process).

Dark-colored or opaque films for use in shrink-wrapping an article are also known in the art. Such films are usually used because of their light-transmission properties; e.g., for blocking ultraviolet or infrared radiation to prevent degradation of the colored surfaces of the product-containing packages, or to achieve a particular aesthetic effect. While shrink-wrapping an article entirely in such film would ostensibly preclude the reading of the individual identification code, an undesirable consequence is that the advertising and product information on the article is obscured. Hence, once the article (or a bundle of articles) reaches the retail location, the worker checking the items and routing them to a particular location must either remove the film or scan an externally applied identification code to learn the contents, which is inefficient. Also, if a bundle of articles entirely wrapped in an opaque or dark colored film is slated for placement on display at a "warehouse" store for sale as a single unit, the prospective customer would be unable to see the advertising indicia or product information applied to the underlying article. In some instances, the ability to perceive or visualize the advertising indicia or product information is crucial, since it may make the difference in the customer selecting one brand over another and consummating the sale.

Another approach could be to apply the label bearing the "bundle code" over the corresponding surfaces of the articles bearing the individual identification codes. However, modern sophisticated automated scanners are capable of reading the identification codes through conventional single-ply, while-colored, clear adhesive-backed labels, or the scanner or a human may still read the code if only a portion of it is covered by the label. For this reason, the use of such labels in an attempt to cover identification codes alone may not be a viable solution.

Accordingly, a need is identified for an improved method for bundling a plurality of articles that overcomes the above-identified limitations and shortcomings.

SUMMARY OF THE INVENTION

In accordance with one aspect of the invention, a method of forming a single, separately identifiable bundle from a plurality of adjacent articles, each bearing product information or advertising indicia, while substantially obscuring an individual identification code on a common surface of each of the articles is disclosed. The method comprises at least partially wrapping the articles to form the bundle such that the product information or advertising indicia on at least one article is at least partially viewable while substantially obscuring the individual identification codes on each of the articles. As a result, the articles in the bundle may be identified from the product information or advertising indicia on the at least one article, but the obscuring prevents an automated scanner or human from reading the individual identification codes and identifying the bundle as a single article.

In one embodiment, the obscuring is accomplished by placing a relatively thin piece of a paperboard or cardboard material adjacent to the common surfaces of the articles bearing the individual identification codes. In this embodiment, the wrapping step includes placing a first film entirely around the plurality of articles and the paperboard or cardboard. Preferably, the first film is selected from the group consisting of polypropylene film, polyethylene film, polyolefin film, polyvinyl chloride film, and cellophane, and the method further includes: (a) shrinking the first film to substantially secure the articles in the bundle against movement relative to each other; and (b) applying a bundle identification code to the bundle once formed.

In a second embodiment, the wrapping step may include placing a first film entirely around the plurality of articles, in which case the obscuring is accomplished by attaching a label to the first film having at least one relatively dark, patterned or opaque surface (or layer) over the common surfaces of the articles, the label bearing the bundle identification code. The dark, patterned or opaque surface or layer prevents the automated scanner from reading the individual identification codes. Preferably, the label is self-adhesive and includes a backing, with the dark, patterned or opaque surface of the label being adjacent to the backing and the bundle identification code being provided on an exterior surface of the label.

In another embodiment, the wrapping step includes placing a first film only partially around the plurality of articles and the obscuring is accomplished by placing or wrapping a second dark-colored, opaque, or patterned film only partially around the plurality of articles. In this embodiment, the method further includes the step of at least partially securing the second film to the first film to form a sleeve around the articles. The first film may be a transparent or clear film formed of a material selected from the group consisting of polyolefin film, polyvinyl chloride film, polyethylene film, polypropylene film, and cellophane. The method may further include shrinking the sleeve to substantially secure the articles in the bundle against movement relative to each other. Specifically, the first and second films are preferably polyethylene films, in which case shrinking the sleeve may include both heating and cooling the sleeve to achieve the best results. The step of applying an identification code to the bundle may also be included.

In still another embodiment, the step of wrapping the articles in a first film comprises placing an open-ended film sleeve or band over the articles and shrinking it to form the bundle, with the sleeve or band leaving at least a portion of the advertising indicia or product information on at least one of the articles exposed for viewing. In this embodiment, obscuring of the individual identification codes may be accomplished by placing a label having a dark, patterned or opaque surface on the film sleeve after shrinking, by positioning a substantially thin piece of paperboard or cardboard adjacent to the articles before shrinking the film sleeve, or by providing at least a portion of the film sleeve with a dark coloring that prevents a scanner or human being from reading the individual identification codes. Still another alternative is to simultaneously allow for the viewing of the product information or advertising indicia and the obscuring of the codes by providing the film sleeve or band with a pattern. The pattern would prevent a scanner or human from fully reading the individual information codes, but allow for the product information or advertising indicia to be visualized or perceived.

In accordance with a second aspect of the invention, a method of forming a single, separately identifiable bundle from a plurality of adjacent articles forming a group while substantially obscuring an individual identification code on a surface of each of the articles, such as to prevent an automatic scanner or human from fully reading the code, is disclosed. The method comprises placing a first film at least partially over the group of articles, the first film at least partially exposing at least one surface of one of the articles for viewing; placing a second film at least partially over the group of articles, the second film substantially obscuring the identification code on another surface of each article; at least partially securing the first film to the second film on at least two sides of the group of articles to form a sleeve; and shrinking the sleeve to form the bundle.

In one embodiment, the first film is a clear, transparent film and the second film is a dark colored, opaque, or patterned film. The first and second films preferably comprise polyethylene films fed from continuous rolls, and securing the first film to the second film includes forming a first seal from the loose ends of the first and second films before the placing steps. Then, a heated device or cutter is used to simultaneously sever the first and second films from the continuous roll and form a second seal adjacent a second side of the bundle after the placing steps. The steps of placing the films may include advancing a first group of a plurality of articles into a first seal formed between the free ends of the first and second films and then forming a second seal adjacent a trailing surface of the group of articles, wherein the formation of the second seal forms a new first seal for a next-in-line group of articles to be bundled. Shrinking the sleeve to form the bundle may include initially heating the sleeve and then cooling the sleeve to shrink the films and form the bundle. The step of placing an identification code on the bundle may also be practiced, with the code identifying at least the type and number of articles in the bundle. The code may also identify any anti-theft device in or on one or more of the plurality of articles or the bundle.

In accordance with a third aspect of the invention, a multi-pack assembly or bundle is provided. The bundle or assembly comprises a plurality of articles positioned adjacent to each other in a group, each of the articles including advertising indicia or product information on at least one surface and an individual identification code on another surface; and a film covering the group of articles to form the bundle. The film covers the group of articles such that the advertising indicia or product information on at least one article is at least partially exposed for viewing, while the identification codes on each of the articles are substantially obscured.

In one embodiment, the film is shrunken over the articles and is comprised of a first piece of transparent or clear film secured at both ends to a second piece of colored or opaque film, whereby the transparent film may expose the advertising or product information for viewing while the colored or opaque film prevents a scanner from reading the individual product codes on the articles. The first and second films may be selected from the group consisting of polyvinyl chloride films, polyolefin films, polypropylene films, polyethylene films, cellophane, and combinations thereof. Preferably, the film is a sleeve comprised of a single piece of material open at both ends and at least partially opaque, colored, or patterned to prevent a scanner or human being from reading the individual identification codes on the articles. Alternatively, the film may completely cover the articles and include a pattern that allows an observer to discern the advertising indicia or product information while preventing the scanning of the individual identification codes. The assembly may further comprise a label bearing a bundle identification code for identifying the group of articles on the sleeve.

In accordance with a fourth aspect of the invention, a method of repackaging a plurality of articles, each bearing advertising indicia or product information and an individual identification code on a common surface or side, taken from a shipping container into one or more separately identifiable bundles, is disclosed. The method comprises: (a) bundling at least two of the articles together using a film such that advertising indicia or product information on at least one article is at least partially viewable but the identification codes on all articles are substantially obscured; (b) applying a bundle identification code for identifying a characteristic of the bundled articles to the film; and (c) returning the bundle to the shipping container. The method may further include repeating steps (a)–(c) for all the articles in the shipping container.

In one embodiment, bundling at least two of the articles together includes wrapping or placing a film entirely around the plurality of articles. The bundle identification code may be provided on an exterior surface of a label having a relatively dark, patterned or opaque surface or layer attached to the film adjacent to the common surfaces or sides of the articles bearing the individual identification codes. The dark, patterned or opaque surface or layer prevents an automated scanner or human from fully reading the individual identification codes. A second embodiment is for the bundling step to include positioning a relatively thin piece of cardboard or paperboard adjacent to the common surfaces or sides of the articles bearing the individual identification codes and either placing a film sleeve or band over the articles, or wrapping the film around the plurality of articles and the cardboard or paperboard. The film may include a first a first film, and the bundling step may include placing the first film at least partially over the articles such that at least one surface of each of the articles is exposed for viewing and placing a second film at least partially over the articles, with the second film substantially obscuring the identification code on another surface of each article, and securing the first film to the second film at two locations to form a sleeve.

BRIEF DESCRIPTION OF THE DRAWING FIGURES

FIG. 1 shows a prior art bundling arrangement in which a clear, transparent film covering is formed over a group of articles;

FIG. 1*a* illustrates that, using the arrangement in FIG. 1, the individual identification codes on the articles remain exposed for scanning by an automated scanner or reading by a human;

FIG. 2 shows a multi-pack bundle formed in accordance with one aspect of the present invention, including a composite sleeve formed of a first transparent film and a second dark-colored or opaque film, whereby the advertising indicia or product information can be observed, but the individual identification codes are fully obscured;

FIG. 3*a* is a schematic view showing one possible process for forming the bundle of FIG. 2;

FIG. 3*b* is a close-up schematic view illustrating one step in the process;

FIG. 3*c* is a close-up schematic view illustrating another step in the process;

DETAILED DESCRIPTION OF THE INVENTION

Figure 1A:
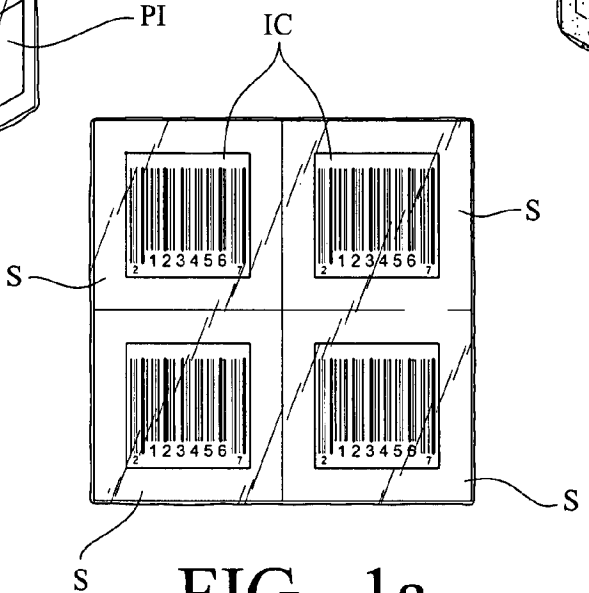
FIG. 1a (PRIOR ART)
Figure 1:
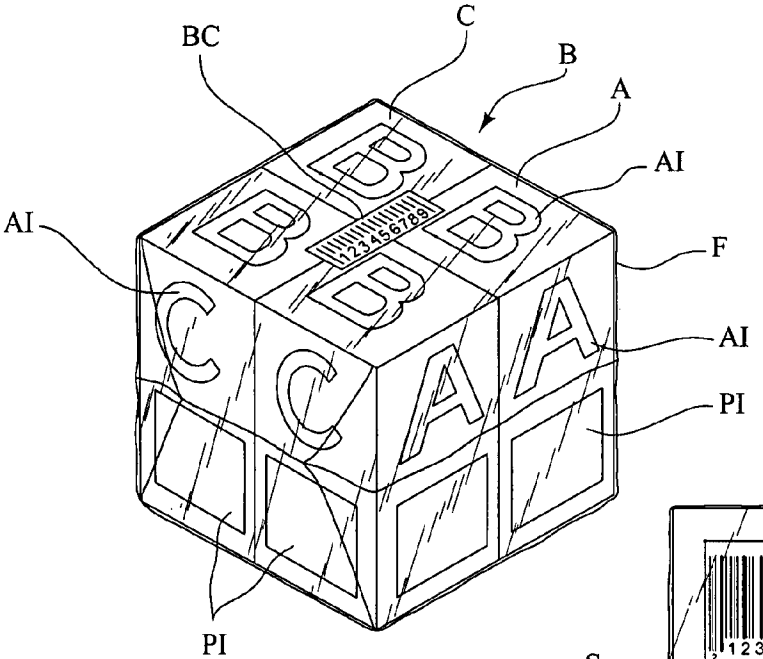
FIG. 1 (PRIOR ART)

Reference is now made to FIG. 1, which shows a conventional bundle B formed of a group G of articles A. For purposes of illustration, the articles A are shown as rectangular cartons C of the type typically used for holding products such as film, ink-jet cartridges, or other small to moderately sized, eccentrically shaped items for which pre-packaging prior to shipment or display is desirable. However, it should be appreciated that many different types and shapes of articles A can be bundled together, including cylindrical articles (bottles, cans), flat articles (jewel boxes for compact discs or DVDs), round articles, or any other type of article, without limitation. Also, while four articles A are illustrated as forming the group G, it should be appreciated that any combination of two or more articles may form a bundle B.

As shown in FIG. 1*a* and explained further below, a corresponding or common surface of each article A typically includes an individual identification code IC in the form of a scannable or otherwise computer readable code, such as the ubiquitous universal product code (UPC or bar code) comprising a plurality of dark bars and a corresponding numerical identifier. This individual identification code IC may be placed on any surface of the article A, but is usually located on the bottom surface S, as illustrated in FIG. 1*a*, such that it is not only less noticeable to the consumer, but also easy to scan during checkout at the retail store. However, it is also commonplace to locate the individual code IC on the lower half of a lateral side portion of the article A, such as at the bottom rear corner (not shown), where it is also less noticeable and easy to scan during checkout.

Typically, the articles A are bundled together using an externally-applied film F, such as a clear or substantially transparent single ply film made of a polymeric material, including polyethylene, polypropylene polyolefin, cellophane, or polyvinyl chloride (the latter being the most expensive and somewhat environmentally unfriendly and, hence, being the less preferred choice). The film F may be provided in the form of an open ended sleeve or band (not shown), but may also be provided on one or more continuous rolls (see FIG. 3). A variety of techniques and machines for applying such a sleeve, band, or film F over the articles A and shrinking it to form the bundle B are known in the art. Perhaps one of the more popular approaches used the conventional "C-fold" wrapping technique, which relies a single roll of film F manipulated into a C-shape for receiving the group G of articles A. More specifically, a plurality of articles A positioned adjacent to one another are advanced into the C-shaped film, such as by a pusher or conveyor. Once the group G of articles A is surrounded by the film on four sides, and an "L-bar" type sealing jaw including a heated knife or cutter is then used to sever and seal the film F adjacent to the lateral (left or right) sides and the trailing side of the group G of articles A. One example of a shrink-wrapping machine utilizing this wrapping technique is the popular Hanagata HP-30Z, manufactured and distributed by the Hanagata Corporation of Toyama-ken, Japan. This wrapping-assist device and L-bar sealer used in this machine are both described in detail in Hanagata's U.S. Pat. No. 5,603,202, the disclosure of which is incorporated herein by reference.

Regardless of the wrapping technique used, the film F placed over, wrapped around, or covering the articles A is then usually subjected to a heating process such that it shrinks over the bundle B, thereby temporarily securing the articles A together against movement for more efficient distribution as unit. Once formed, a label L bearing a bundle identification code BC may also be externally applied to the bundle B. The bundle identification code BC typically includes information on the number and types of articles A in the bundle B, and may also include other miscellaneous information, such as the presence and type of anti-theft devices (e.g., an "S" tag or a "C" tag) on the articles A or in or on their cartons C included at the behest of the retailer.

Using clear, transparent film F alone for shrink-wrapping bundles of articles A is advantageous, since it is much less expensive than cardboard carriers and further allows an observer to visually perceive any advertising indicia AI, product information PI, or the like printed on one or more surfaces of the carton C (see FIG. 1). However, the transparent film F also creates a substantial disadvantage because the individual identification code IC on each article A remains visible, not only to automated scanners at the distribution center or retail check-out station, but also to human observers. As described in detail above, having two exposed, "universally" readable codes BC and IC is undesirable and can have deleterious consequences. Accordingly, the present invention provides a solution by using several possible methods of bundling together multiple articles A, such as the cartons C shown in FIG. 1, so as to allow an observer to at least partially perceive or visualize the advertising indicia AI or product information PI on at least one of the articles A while at the same time obscuring individual identification codes IC. In addition to the methods, part of the invention disclosed is the resulting multi-pack assembly or bundle B of articles A.

Figure 2:
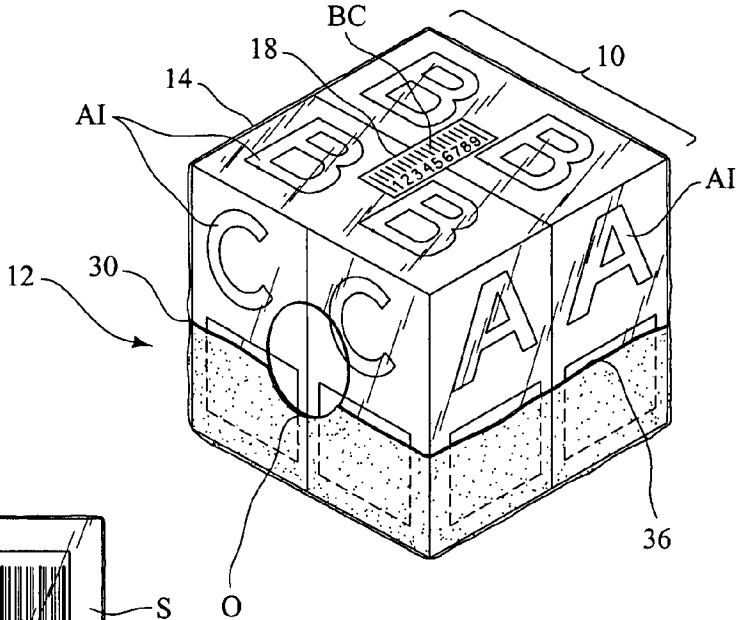

With reference now to FIG. 2, one embodiment of the multi-pack assembly or bundle 10 constructed in accordance with the principles of one aspect of the present invention is disclosed. As described above, the bundle 10 includes a plurality of articles A, such as rectangular-shaped cartons C containing products, with the cartons each bearing an individual identification code IC. However, instead of being wrapped entirely in a clear or transparent film F, the articles A are collectively held together in the bundle 10 using a "composite" shrink-wrapped sleeve 12 formed of a first clear or transparent film 14 and a second film 16 capable of obscuring the reading of the underlying individual identification codes IC on the articles A. The obscuring may be accomplished by using a dark-colored, but translucent film (black or other like colors), an opaque film (black, white, or any other color), a patterned, partially transparent film (e.g., one having cross-hatching, striping or the like), or any other type of arrangement that works for the purpose of making a machine-readable code non-readable. However, for purposes of illustrating a preferred embodiment, the film 16 is shown and described as being a single-ply dark-colored, non-translucent/opaque black film.

The dark-colored film 16 used in the preferred embodiment described herein advantageously prevents any of the individual identification codes IC on the articles A from being read by an automated scanner or human. Nevertheless, the bundle 10 can be identified by scanning or reading the bundle identification code BC printed on a label 18 applied to the sleeve 12, and any advertising indicia AI or product information PI on the upper portion of the articles A covered by the clear or transparent film 14 remains fully visible to the outside observer, including possibly a worker receiving the bundle 10 and directing it for placement on the shelf at a retail store, or a customer, in the case of a warehouse-type store. The ability to perceive or visualize the indicia/information AI, PI also allows the worker at the distribution center to easily verify any information obtained from a bundle identification code BC using an automated scanning device, such as a conventional bar code reader.

One example of a machine for forming and shrinking the composite sleeve 12 over the articles A to form the bundle 10 is now described in detail. As shown schematically in FIG. 3*a*, the first and second films 14, 16 may be provided on continuous rolls 20, 22, respectively. The rolls 20, 22 are preferably rotatably supported in an opposed fashion (and back-up rolls (not shown) may be provided adjacent to the "primary" rolls 20, 22 to increase efficiency in the case that one runs out and a splice becomes necessary). The films 14, 16 are preferably fabricated of single-ply polyethylene, which allows for the resulting bundle 10 to be formed at a very low cost (but possibly without the glossy look and smooth, non-waxy feel afforded by other, more expensive films). However, as noted above, other types of films typically used for shrink-wrapping or bundling articles A may also be used, including for example polypropylene, polyolefin, polyvinyl chloride, and cellophane. The films 14, 16 may also be of any width, but the width is preferably selected such that it is greater than the width dimension of the group G of articles A, so as to ensure at least partial coverage of the lateral sides of the group when the composite sleeve 12 shrinks.

As part of the wrapping machine, a plurality of tensioner or "dancer" rollers 24 are also provided for ensuring that the proper tension is provided on the films 14, 16 as they simultaneously travel toward a product receiving area 26. Just upstream of the last roller 24 in the group and next to the product receiving area 26, a device for severing and sealing the films 14, 16 together is provided. In the most preferred embodiment, this device comprises a pair of opposed sealing jaws 28 that are selectively actuated to move in a vertical direction. As illustrated, the jaws 28 are positioned adjacent to the product receiving area 26, with at least one of the jaws including a heated knife or wire for severing and sealing the two films 14, 16 together, with the other jaw serving as a stop for the heated knife or wire. While this arrangement generally results in a very reliable operation, it is within the broadest aspects of the invention to use another type of cutting device to sever and seal the films 14, 16. Shrink-bundling machines that include the ability to form the composite sleeve 12 over the articles A using film taken from two rolls are manufactured and distributed by the Great Lakes Corporation of Schiller Park, Ill., and sold as the 708 Series of machines, and also under model numbers 1627CSS, 16500, and 16700.

Figure 3A:
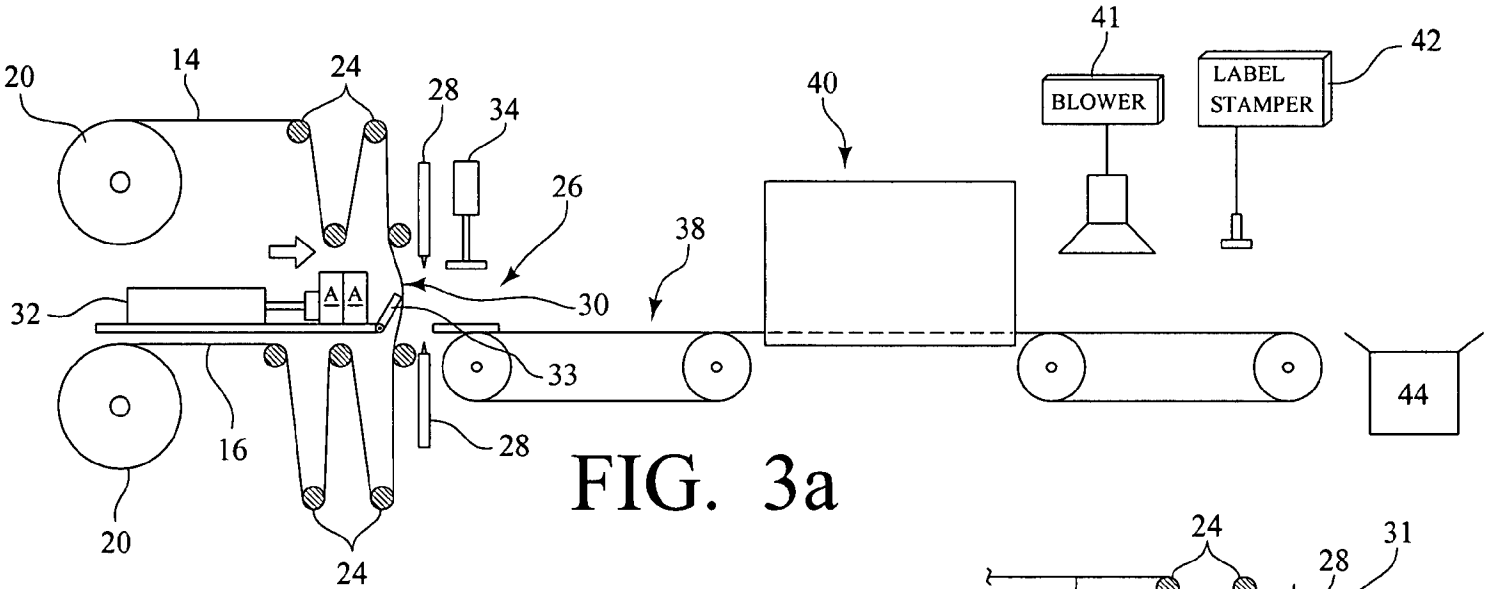
Figure 3C:
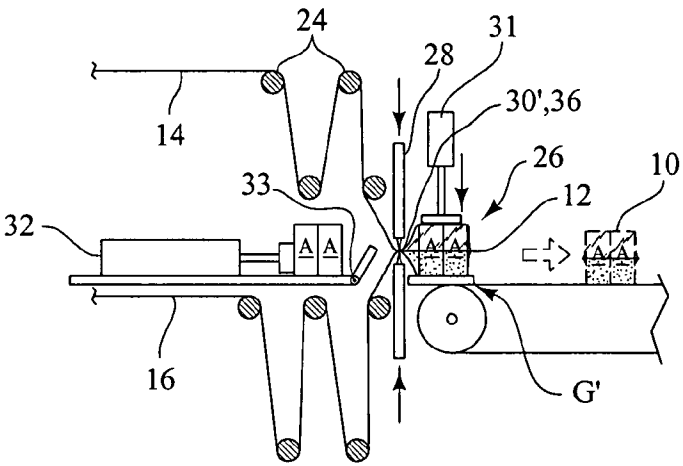
Figure 3B:
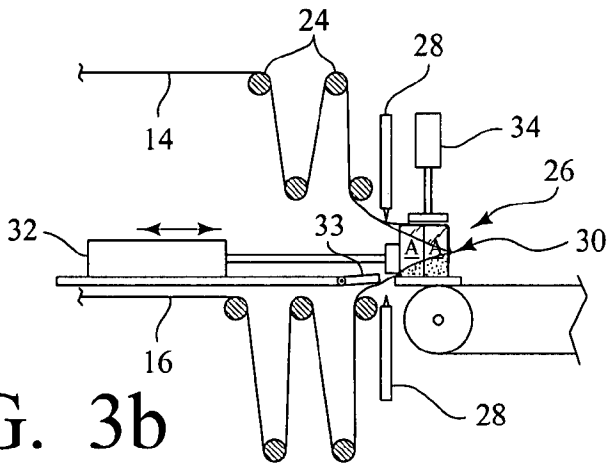

For purposes of illustrating the method, it should be assumed that a seal 30 is already formed between the free ends of the respective films 14, 16, just in advance of the product receiving area 26. At the product receiving area 26, groups of individual articles A positioned in juxtaposition are advanced toward the seal 30 securing the films 14, 16 together, such as by using a hydraulic or pneumatic ram 32. As shown in FIG. 3*a*, a pivoting bridge 33 may be provided adjacent to the lower jaw. This bridge 33 is capable of pivoting to a substantially horizontal position to allow the group G of articles A being pushed by the ram 32 to pass, but then pivotably retracting to a vertical position to allow the lower sealing jaw to advance toward the upper sealing jaw and help to sever the films 14, 16 and create the seal 30. In any case, as a result of the advancing of the articles A, the films 14, 16 are placed over the leading surface of the entire group G, as well as the top and bottom surfaces thereof, and a selectively actuated holddown device 34 is used to hold the film-covered articles A in place. The bridge 33 is then retracted, and the sealing jaws 28 are then simultaneously actuated to close down on the films 14, 16 adjacent to the trailing edge of the group of articles A. As a result of the heated knife or wire (not shown) present on one or both of the jaws 28, the films 14, 16 are severed and a seal 36 is simultaneously created, thereby forming a loosely fitting sleeve 12 that is open at two opposed ends, which extend beyond the lateral side edge of the group G. It should be further appreciated that the formation of the seal 36 not only keeps the free ends of the films 14, 16 secured together, but also creates the seal 30' against which the next-in-line group G of articles A is advanced by the ram 32.

As a result of the advancing of the next-in-line group G' of articles A by the ram 32, the group of articles A covered by the sleeve 12 are then advanced onto a conveyor 38, such as one including a driven, endless conveyor belt. In the case of polyethylene film, the conveyor 38 transports the loose bundle into a temperature control device 40, such as a heating or cooling tunnel. In the preferred embodiment, the device 40 initially heats the polyethylene films 14, 16 forming the sleeve 12 to the appropriate temperature for setting (usually above 160° C.). A cooling device, such as a blower 41, is then used to cool the films 14, 16 such that the sleeve 12 substantially shrinks over the group G of articles A, which are thus completely covered on four sides and partially covered on the other two (which represent the unsealed "bullseye" openings O in opposite ends of the sleeve 12), with the articles A held closely together in a bundle 10 and generally prevented from moving relative to each other as a result of the shrinking process. Advantageously, as shown in FIG. 2, the clear or transparent portion of the sleeve 12 allows for the articles A in the bundle 10 to be identified by an outside observer; yet, the individual identification codes IC are completely obscured and, hence, cannot be read, either by an automated scanner or a human being.

The bundle 10 may then be provided with the label 18 including the bundle identification code BC, either manually or using an automated label stamper or applicator 42. Once appropriately labeled, the bundle 10 may be placed in the shipping container 44 originally designed for receiving a predetermined number of the articles A (or returned to the shipping container the articles A were delivered in, if a contract packager is used). Advantageously, the addition of the shrunken film 14, 16 to the bundle 10 requires very little additional space in the container 44 or carton. This means that the bundles 10 are easily placed in or returned to the shipping container 44, and avoids requiring the manufacturer to have two different sizes of shipping containers or cartons on hand (one for non-bundled, loose articles, and one for multi-pack bundles of articles A), as may result if a bulky cardboard carrier or tray (not shown) is used in bundling the articles A.

An additional advantage afforded by the above-described process of forming the composite sleeve 12 is the ability to select the height of the portion formed by the dark colored, opaque (or patterned) film 16 by simply adjusting the stroke of the sealing jaws 28. Hence, if the individual identification codes IC are located on an upper portion of the lateral side of each article A in the group (such as may be the case in bottled water), the lower sealing jaw may be advanced a greater distance than the upper sealing jaw in forming the seal 30, 30', 36, such that the portion of the sleeve 12 comprised of the film 16 that blocks the machine reading of the individual identification codes IC is greater. Consequently, once the shrinking process is complete, a greater portion of the sides of the articles A are covered, which ensures that the individual identification codes IC are obscured. Nevertheless, at least the entire top surfaces of the articles A in the group G, and usually at least a portion of the side surfaces, is covered by the clear or transparent film 14 such that an observer may visually perceive any advertising indicia AI or product information PI without the need for unbundling the articles A (as would be the case if the articles A were bundled in an entirely dark-colored or opaque film). As briefly mentioned above, this also allows for the articles A to be displayed as a multi-pack bundle 10, if desired, such as for sale at a wholesale or warehouse type establishment. Conversely, when the individual identification code IC is on the bottom surfaces of each article A, as shown in FIG. 1*a*, or on a lower portion of a lateral side of each article A (such as in the case of bottles or soda cans), the lower jaw may travel only a short distance such that only the lowermost portion of the bundle 10 is covered by or wrapped in the obscuring or blocking film 16, and the major portion of the bundle 10 is covered by or wrapped in the clear or transparent film 14. As should further be appreciated, the film rolls 20, 22 could also be reversed, or the articles A simply reoriented prior to wrapping, to achieve the same result where the individual identification codes IC are on a top surface of the articles A.

Figure 4:
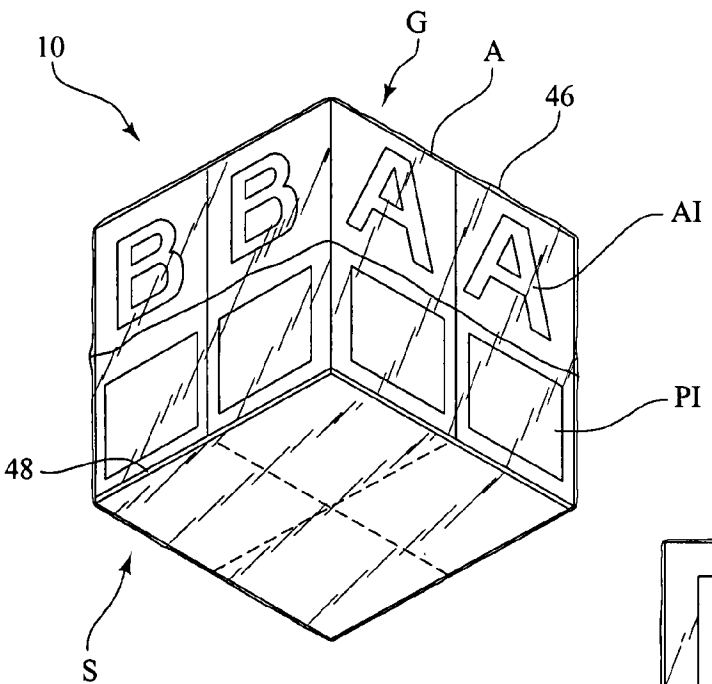
FIG. 4 shows an alternate embodiment in which a transparent film covering is used in combination with a cardboard or paperboard insert for obscuring the individual identification codes.

A second embodiment is shown in FIG. 4, and may involve the use of conventional C-fold wrapping techniques using a clear or transparent film to form a covering 46 (with the end product being shown), a single sleeve formed of a clear or transparent film (not shown), or the above-described technique, but possibly using two rolls of clear film (not shown), or alternatively a clear pre-formed sleeve, band or bag. In any case, an obscuring structure, such as a thin piece of paperboard or cardboard 48, is placed adjacent to a common surface of the group G of articles A bearing the individual identification code IC prior to bundling. For example, in the case of the articles A being of a type shown in FIG. 1*a*, the cardboard or paperboard 48 would be placed adjacent to the underside surfaces of the articles A bearing the individual identification code IC, and preferably held in place using a non-destructive or low-strength adhesive (e.g., a well-known adhesive commonly referred to in the vernacular as "snot glue"). The group of articles A with the cardboard or paperboard 48 in place may then be wrapped using one of several possible techniques: (1) using the C-fold technique to form a film wrapper sealed on three sides to form the shrink-wrapped bundle shown in FIG. 4; (2) using a preformed open-ended (PVC), tubular sleeve or band formed of a clear or transparent material to form the shrink-wrapped bundle (not shown) FIG. 4*a*; (3) forming the sleeve using two rolls of clear or transparent film and sealing jaws, which essentially creates a bundle 10 having insert 48; or (4) any other known technique, including using a preformed film bag. In any case, the appropriate combination of shrinking and setting is employed (which usually involves exposing the film to a temperature change (heat or cooling), the amount of which depends on the thickness and composition of the film(s)) to form a tight, shrink-wrapped bundle 10. Certain types of films, such as polyethylene, require a cooling step to ensure that the best results are achieved.

As should be appreciated, this alternative approach provides many of the advantages of the technique described above, and can be adapted for use with different types of wrapping techniques. The obscuring structure, such as the cardboard or paperboard 48, is sufficiently opaque or dense to prevent the reading of the individual identification codes IC on each of the articles A, either by a machine (such as an automated scanner) or a human being. However, shrink-wrapping the bundled articles A using a clear or transparent film allows for any advertising indicia AI or product information PI on the top and sides of the articles A to be fully visualized. Moreover, the paperboard or cardboard 48 is thin and unobtrusive, since it covers only one side of the group G of articles A. Accordingly, returning the bundles 10 formed of groups G of all the articles A originally slated for shipment to the original shipping container or carton 44 is not a problem.

Figure 5:
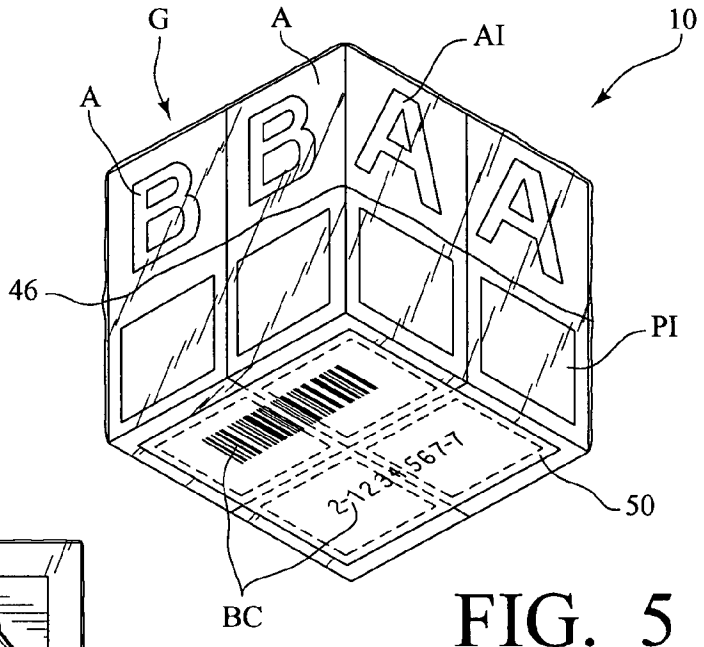
FIG. 5 shows another alternate embodiment in which a transparent film covering is used in combination with a special label for obscuring the individual identification codes.
Figure 6:
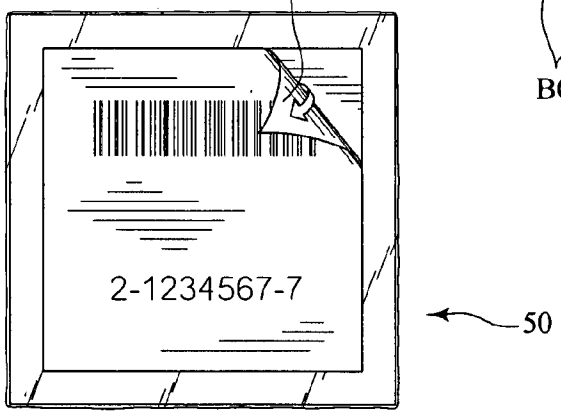
FIG. 6 shows the label used in the preferred version of the embodiment shown in FIG. 5.

As shown in FIG. 5, a third approach is to essentially shrink-wrap the group G of articles A using one of the techniques described above so as to form a shrink-wrapped film covering 46, or any other known technique not mentioned here, without using the cardboard or paperboard insert 48. Instead, the obscuring structure in this embodiment is in the form of a label 50 for application to the common surfaces of the articles A bearing the individual identification codes IC. However, rather than a conventional white label with a clear adhesive backing, a special, self-adhesive single-ply label having a dark, patterned or opaque surface 52 (preferably the backside) is used (see FIG. 6). This dark, patterned or opaque surface 52 may be formed by adding ink to the adhesive backing (either the entire backing or selected portions thereof, as long as the coverage is adequate to prevent the machine reading of the individual identification codes IC), or by simply printing a darkened block or cross-hatching on the rear of the label 50 before the application of the adhesive. A multi-ply label with a dark, patterned, or opaque layer could also be used, but this of course would increase the cost. Different types and sizes of labels having darkened adhesive backings are currently available, such as from Turner Label in Lexington, Ky., but are presently used only for covering existing labels bearing identification codes on shipping cartons to provide corrected product information, rather than for obscuring the individual identification codes IC on the articles A in a multi-pack bundle 10. Advantageously, the opposite surface of the label 44 can receive the bundle identification code BC, thereby dispensing with the need for a separate label 18 (see FIG. 5).

Figure 7:
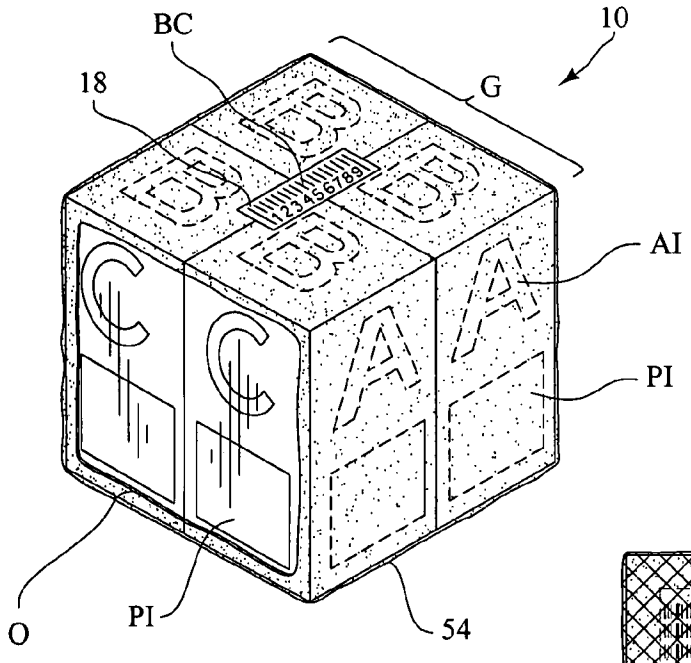
FIG. 7 shows another embodiment in which a dark-colored or opaque band or sleeve is used to cover the articles such that the individual identification codes are obscured, but the advertising indicia and product information is at least partially exposed for viewing.

As shown in FIG. 7, yet another possible approach for bundling a group G of articles A such that the individual identification code IC is obscured is to use a sleeve or band (not shown) completely comprised of an opaque, patterned or dark-colored film (such as black-colored, opaque polyvinyl chloride film) that is shrunken over the articles 10 to form a covering 54 (commonly known as "shrink-banding" in the art). The sleeve or band is preferably preformed as a tubular piece of film of a predetermined circumference and length to accommodate a certain number of articles A (but could also be a "composite" sleeve formed using the technique described above for securing two films together, in which case, both rolls would be opaque, patterned or dark colored film, and the resulting covering would have seams where the seals are formed).

In practice, the group G of articles A is inserted in the sleeve or band to form a "loose" bundle, which is then heated to shrink the sleeve or band and form the "tight" bundle 10 with the covering 54. As should be appreciated, in this embodiment, four surfaces or sides of the group G of articles A in the bundle 10 are completely covered, including preferably the surfaces bearing the individual identification codes IC, with the dark-colored, opaque, or patterned film. However, the other two surfaces remain mostly exposed through an opening O as a result of the gap, or "bullseye" as it is known in the art, formed on opposite sides of the group G of articles A when the sleeve shrinks to form the covering 54. Through this "bullseye," an observer can see a portion of the advertising indicia or product information on the article A (note full line lettering in FIG. 7, as opposed to phantom lettering), and thereby discern the contents of the bundle 10 (especially when the articles are relatively tall, such as boxes of cereal, bottles, or the like, and the margins are free). As a result, the individual identification codes IC on the articles A are obscured, which advantageously eliminates the chance of error in scanning a bundle identification code BC on a label 18 applied to the bundle 10 and ensures that it is counted as a multi-pack.

Unlike with cardboard carriers having fixed dimensions in which the articles A must be placed in a particular orientation, the position or type of the sleeve or band or the orientation of the articles A may be selected as necessary to ensure coverage of the individual identification codes IC without incurring the substantial costs associated with redesigning the carrier. For example, where the identification codes IC are on the sides of the articles A, the band or sleeve may be wrapped around these sides, leaving the top and bottom surfaces substantially exposed. If on the other hand the identification code IC is on the top or bottom surface, as shown in the drawings, the band or sleeve may be placed over the leading and trailing surfaces, as well as the top or bottom surfaces, to provide the obscuring function. Instead of changing the position of the sleeve or band, it should also be appreciated that the orientation of the articles A could also be changed.

Figure 8:
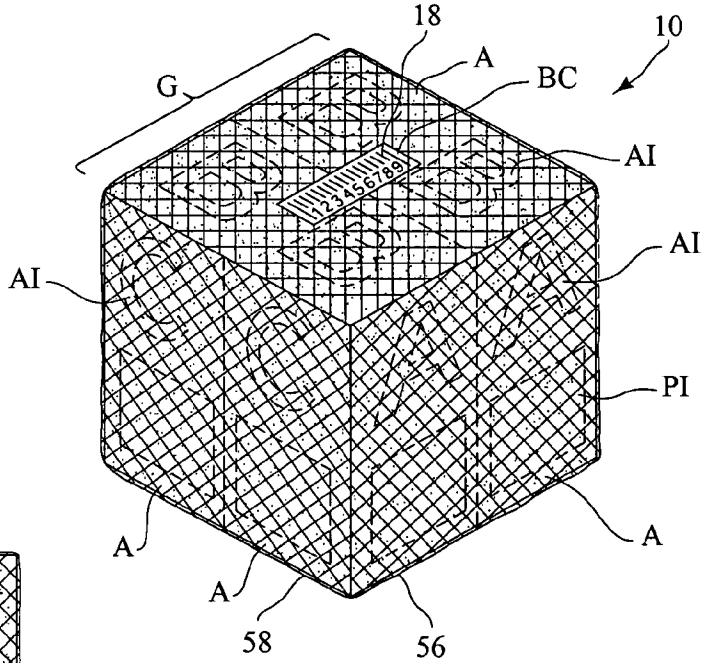
FIG. 8 shows an embodiment in which a patterned film is used to cover a group of articles to form a bundle such that the advertising indicia and product information can be perceived by a human, but the individual identification codes are substantially obscured from an automated scanner.
Figure 8A:
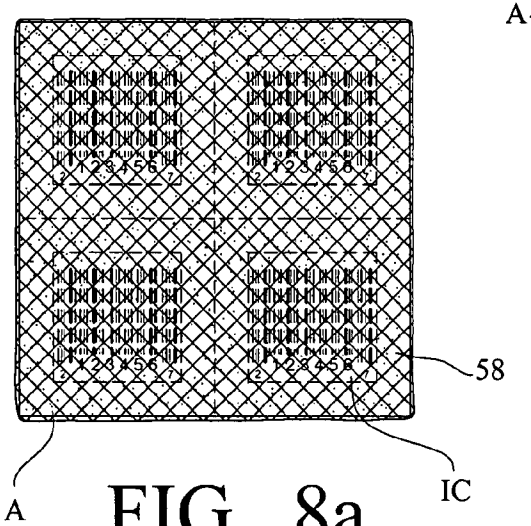
FIG. 8*a* illustrates the manner in which the individual codes are substantially obscured by the pattern.

As shown in FIG. 8, the articles A may also be shrink-wrapped, bundled, or banded to form a covering 56, with the film, sleeve, or band having a pattern 58. The pattern 58 is shown for purposes of illustration as cross-hatching printed on the surface of the particular covering chosen, but any type of pattern capable of performing the dual functions of: (1) allowing an observer to perceive and visualize the advertising indicia AI or product information PI; yet (2) simultaneously obscuring the individual identification codes IC to at least prevent them from being read by an automated scanner, may be used. The covering 56 with the pattern 58 may initially be formed using the C-fold wrapping technique, using the composite sleeve 12 formed from films taken from two separate rolls, at least one of which is patterned, or using a tubular sleeve or band formed of a single piece of patterned material, such as one formed of polyvinyl chloride (the latter two cases forming a bundle 10 that looks more like the ones in FIGS. 2 and 7, with the characteristic "bullseye" openings O, but with a patterned film instead of a dark colored or opaque film). In all cases, the appropriate shrinking measures are undertaken (e.g., heating and/or cooling at a temperature supplied by the film manufacturer for a minimum duration) to ensure that the desired tight bundle 10 is formed.

In summary, various methods for bundling together multiple articles A for selectively obscuring individual identification codes IC on the articles and related assemblies are disclosed. In one embodiment, the method includes forming a composite film sleeve 12 partially of a clear, transparent film 14 and partially of a dark colored or opaque film 16. The composite sleeve 12 is then placed over a group of two or more articles A slated for bundling and shrunken to form the bundle 10. As a result, any advertising indicia AI or product information PI can be viewed by an observer, but the individual identification codes IC are obscured. Hence, the entire bundle 10 can be scanned to locate a bundle identification code BC without the chance of deleteriously reading the individual identification codes IC. Additional methods of obscuring individual identification codes on groups of articles in a bundle 10 while allowing for the visualization of the advertising indicia or product information thereon are also disclosed.

The foregoing description of several aspects of the inventions disclosed herein are presented for purposes of illustration and description. The embodiments described are not intended to be exhaustive or to limit the invention to the precise form disclosed. Obvious modifications or variations are possible in light of the above teachings. For example, in any of the embodiments, a temporary securing means, such as a rubber band, plastic strap, or adhesive, can be used to hold the articles A together in the group G prior to bundling or banding. The means chosen is simply left in place over the group G when the bundle 10 is formed. As briefly mentioned above, the methods may also involve placing an anti-theft device (e.g., an S-tag or C-tag) in or on the articles A, or in or on the bundle 10, as is often requested by the retailer. The embodiments described were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention when interpreted in accordance with the breadth to which it is fairly, legally, and equitably entitled.

What is claimed is:

1. A method of forming a single, separately identifiable bundle of articles, comprising the steps of:

providing a group of articles, each article having an individual identification code on a surface thereof;

placing a first film at least partially over the group of articles, the first film at least partially exposing at least one surface of one of the articles for viewing;

placing a second film at least partially over the group of articles, the second film substantially obscuring the identification code on another surface of each article;

at least partially securing the first film to the second film on at least two sides of the group of articles to form a sleeve; and shrinking the sleeve to form the bundle.

2. The method according to claim 1, wherein the first film is a clear, transparent film and the second film is a colored, opaque, or patterned film capable of obscuring the individual identification codes.

3. The method according to claim 2, wherein:

the first and second films comprise polyethylene films fed from continuous rolls, and securing the first film to the second film includes forming a first seal from the loose ends of the first and second films before the placing steps, and then using a heated device or cutter for simultaneously severing the first and second films from the continuous roll and forming a second seal adjacent a second side of the bundle after the placing steps.

4. The method according to claim 1, wherein the step of placing the films includes advancing a first group of a plurality of articles into a first seal formed between the free ends of the first and second films and then forming a second seal adjacent behind the group of articles, and wherein the formation of the second seal forms a new first seal for a next-in-line group of articles to be bundled.

5. The method according to claim 1, wherein shrinking the sleeve to form the bundle includes initially heating and cooling the sleeve.

6. The method according to claim 1, further including the step of placing an identification code on the sleeve around the articles, the code identifying at least the type and number of articles in the bundle.

7. A method of forming a single, separately identifiable bundle of articles comprising the steps of:

providing a plurality of articles, each article bearing product information or advertising indicia on one or more surfaces thereof, and further having an individual identification code on a surface thereof;

arranging the articles to form the bundle;

wrapping the articles by placing a first film only partially around the plurality of articles such that the product information or advertising indicia on at least one article is at least partially viewable, and then wrapping a second dark-colored, opaque, or patterned film only partially around the plurality of articles so as to substantially obscure the individual identification codes on each of the articles; and at least partially securing the second film to the first film to form a sleeve around the articles, whereby the articles in the bundle may be identified from the product information or advertising indicia on the at least one article, but the obscuring prevents the automated scanner from reading the individual identification codes and identifying the bundle as a single article.

8. The method of claim 7, wherein the first film is a transparent or clear film formed of a material selected from the group consisting of polyolefin film, polyvinyl chloride film, polyethylene film, polypropylene film, and cellophane.

9. The method of claim 8, including shrinking the sleeve to substantially secure the articles in the bundle against movement relative to each other.

10. The method of claim 9, wherein the first and second films are polyethylene films and shrinking the sleeve includes heating and cooling the sleeve.

11. The method of claim 7, further including the step of applying a bundle identification code to the sleeve around the articles.

* * * * *